US007513803B1

(12) United States Patent
Yang

(10) Patent No.: US 7,513,803 B1
(45) Date of Patent: Apr. 7, 2009

(54) FAST PLUGGING POWER LINE CONNECTOR

(75) Inventor: Wen Ho Yang, Taipei County (TW)

(73) Assignee: Sun-Lite Sockets Industry, Inc., Taoyuan (TW)

( * ) Notice: Subject to any disclaimer, the term of this patent is extended or adjusted under 35 U.S.C. 154(b) by 0 days.

(21) Appl. No.: 12/073,378

(22) Filed: Mar. 5, 2008

(51) Int. Cl.
*H01R 13/10* (2006.01)

(52) U.S. Cl. ..... 439/682; 439/352

(58) Field of Classification Search ..... 439/352, 439/660, 682

See application file for complete search history.

(56) References Cited

U.S. PATENT DOCUMENTS 7,252,530 B2 * 8/2007 Shamoto ..... 439/352

* cited by examiner

*Primary Examiner*—Tho D Ta
(74) *Attorney, Agent, or Firm*—Bacon & Thomas, PLLC

(57) ABSTRACT

A fast plugging power line connector includes a female body, a male body, two plugging plates, two line connecting bases and two terminal clips. The female body has a locking projection, a separating wall to divide it into two plugging grooves. The male body has a separating wall to divide it into two terminal grooves, and a restricting projection with a locking hook used to lock together with the locking projection. The plugging plates are fixed in the plugging grooves, respectively having two line-clipping grooves to clamp a power line. The two line connecting bases are inserted in the female body. The terminal clips are installed in the terminal grooves of the male body. With the locking hook of the male body locked with the locking projection of the female body, the power line connector is conveniently and safely assembled by a consumer.

4 Claims, 5 Drawing Sheets

(A-A)

(B-B)

FAST PLUGGING POWER LINE CONNECTOR

BACKGROUND OF THE INVENTION

1. Field of the Invention

This invention relates to a fast plugging power line connector, particularly to one able to be quickly and safely connected and used.

2. Description of the Prior Art

Commonly, a power line connector is used to connect two power lines so as to keep appliances or accessories connected to a power source. However, the conventional power line connectors are often abnormally or incorrectly used to damage the power source or the appliances and the accessories by consumers unfamiliar with the circuit because of their complicated structures or indistinct usage guidance.

SUMMARY OF THE INVENTION

The objective of this invention is to offer a fast plugging power line connector letting a user quickly and safely connect an appliance or an accessory with a power source in accordance with practical requirement.

The main characteristics of the invention are a female body, a male body, two plugging plates, two line connecting bases and two terminal clips. The female body is provided with two pairs of side holes, a locking projection, and a separating wall formed inside to divide it into two plugging grooves. The male body is provided with a separating wall formed inside to divide it into two terminal grooves, and a restricting projection having a locking hook used to lock together with the locking projection of the female body. The plugging plates are fixed in the plugging grooves of the female body, respectively provided with two line-clipping grooves employed to clamp a power line, and a foot extended out from its one end to plug in the female body. The two line connecting bases are inserted in the female body, respectively provided with two line connecting holes, and a pair of elastic hooks used to lock in the side holes of the female body while inserting the line connecting base in the female body. The terminal clips are installed in the terminal grooves of the male body. In assembling, the locking hook of the male body is locked with the locking projection of the female body, with the feet of the plugging plates in the female body plugged and fixed in the terminal clips in the male body.

BRIEF DESCRIPTION OF DRAWINGS

This invention is better understood by referring to the accompanying drawings, wherein.

DETAILED DESCRIPTION OF THE PREFERRED EMBODIMENT

Figure 1:
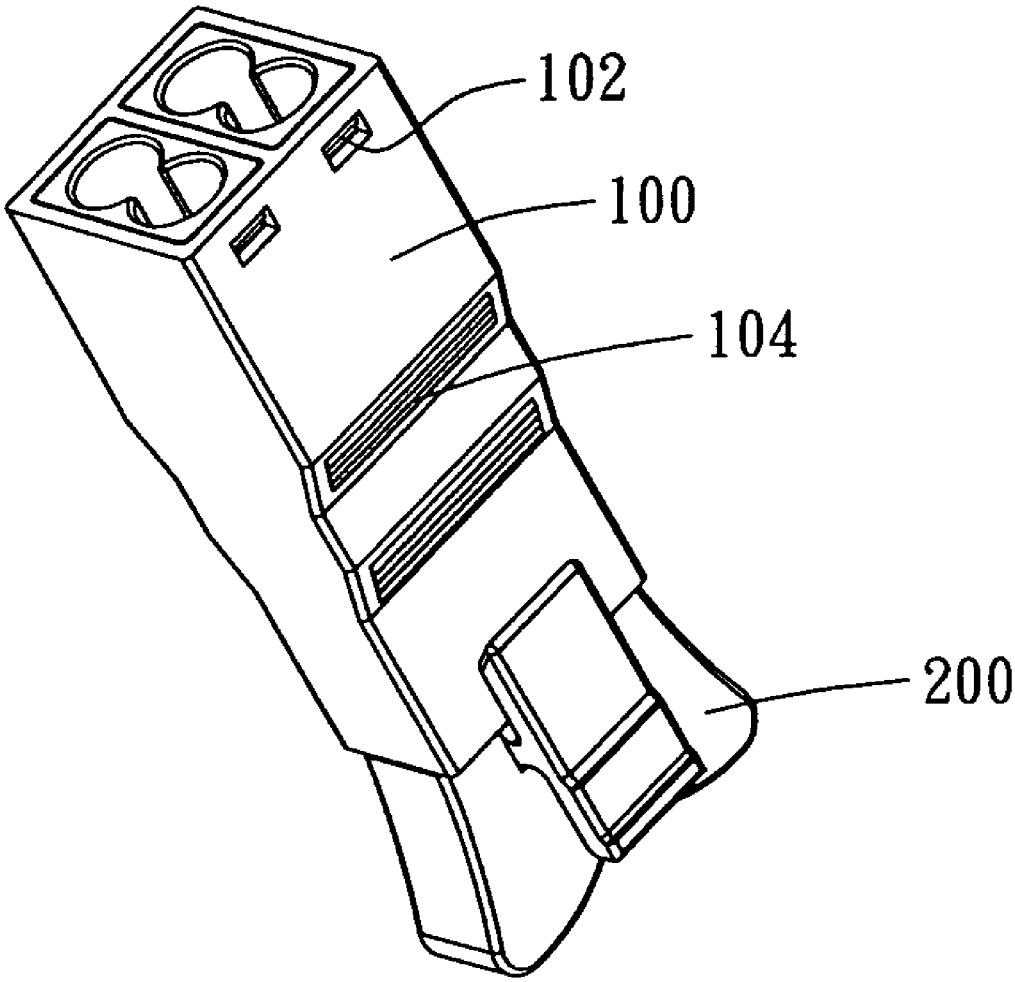
FIG. 1 is a perspective view of a preferred embodiment of a fast plugging power line connector in the present invention.
Figure 2:
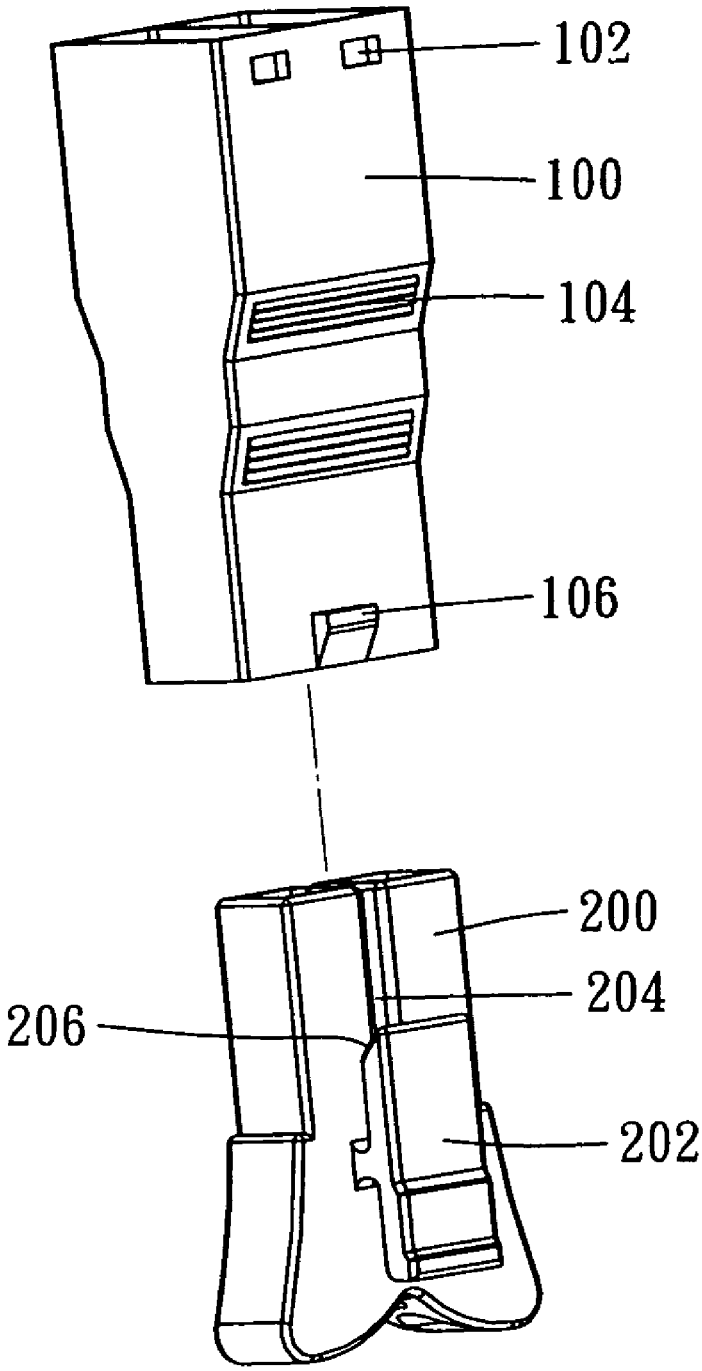
FIG. 2 is an exploded perspective view of the preferred embodiment of a fast plugging power line connector in the present invention.

As shown in FIGS. 1 and 2, a preferred embodiment of a fast plugging power line connector in the present invention includes a female body 100 and a male body 200.

The female body 100 is provided with two pairs of side holes 102 bored in its two parallel sides, an anti-slipping ladder 104 formed of plural projecting ribs, and a locking projection 106.

The male body 200 is provided with a restricting projection 202 having a locking hook 206 employed to mutually lock together with the locking projection 106 of the female body 100, and a direction-indicating groove 204 used for preventing it from being inserted in the female body 100 with a wrong head.

Figure 3:
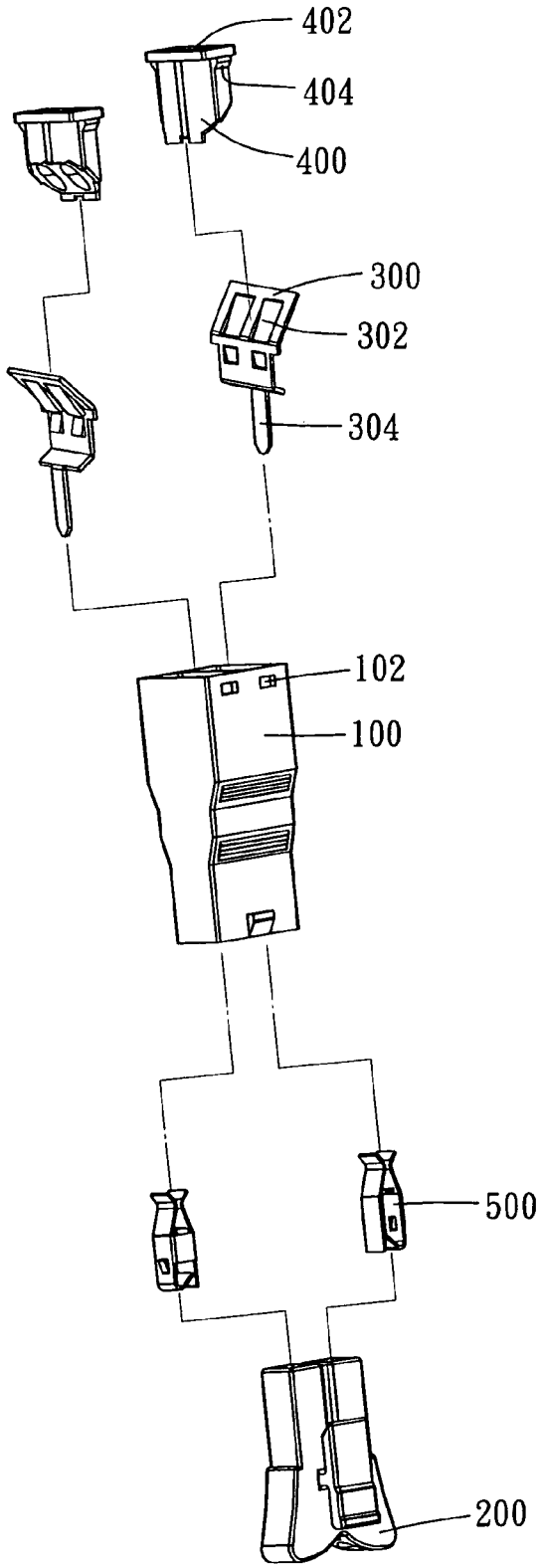
FIG. 3 is a detailed exploded perspective view of the preferred embodiment of a fast plugging power line connector in the present invention.

And, as shown in FIG. 3, the preferred embodiment of the invention is as well provided with two plugging plates 300 and two line connecting bases 400 installed in the female body 100, and two terminal clips 500 fixed in the male body 200. The plugging plate 300 is provided with two line-clipping grooves 302 used to clamp a power line inserted therein, and a slender foot 304 extended out from its one end for being used as a terminal to plug in the female body 100. The line connecting base 400 is provided with two line connecting holes 402, and a pair of elastic hooks 404 located at a position to be locked in the side holes 102 of the female body 100 while inserting the line connecting base 400 in the female body 100.

Figure 4:
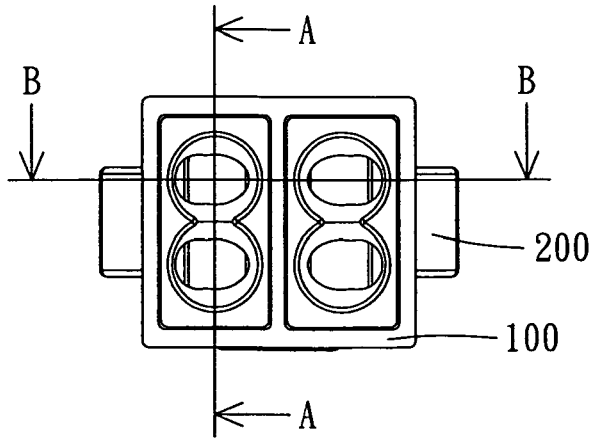
FIG. 4 is a top view of the preferred embodiment of a fast plugging power line connector in the present invention.
Figure 5:
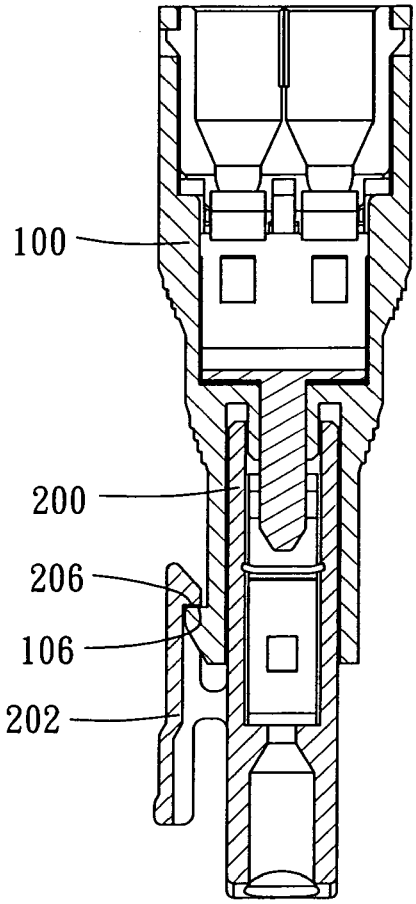
FIG. 5 is a side cross-sectional view of an "A-A" line in the FIG. 4.
Figure 6:
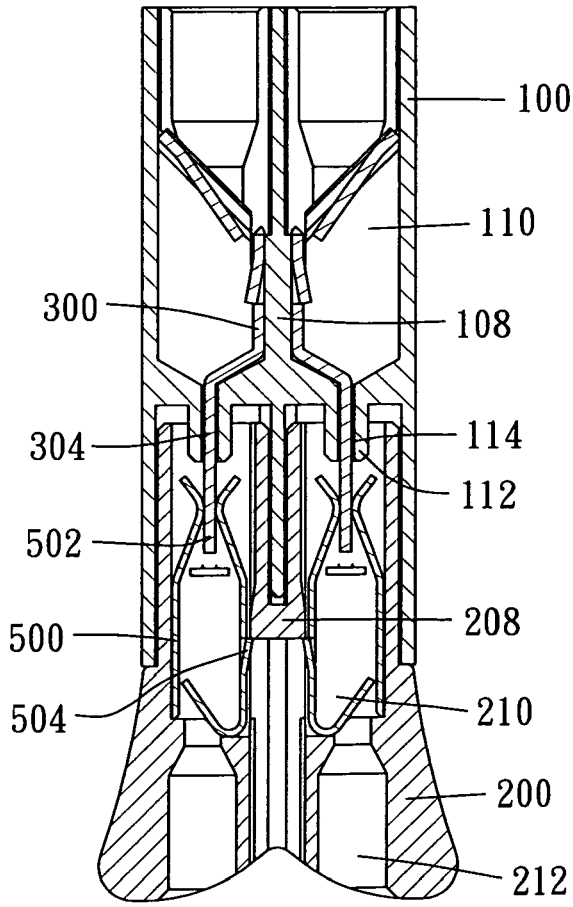
FIG. 6 is a front cross-sectional view of a "B-B" line in the FIG. 4.

Moreover, as shown in FIGS. 4-6, the female body 100 is additionally provided with a separating wall 108 formed inside to divide it into two plugging grooves 110 for the plugging plates 300 to get in, a projection 112 formed at the bottom of each of the plugging grooves 110, and a foot slot 114 dug in each of the projection 112 for the foot 304 of the plugging plate 300 to fit in. The male body 200 is also provided with a separating wall 208 formed inside it to divide the male body 200 into two terminal grooves 210 for accommodating the terminal clips 500. Each of the terminal clips 500 is provided with a clamping mouth 502 and a restricting portion 504 employed to lean against the separating wall 208 of the male body 200. And, formed inside the male body 200 to communicate with the two terminal grooves 210 are two plugging holes 212.

In assembling, first, the plugging plates 300 and the line connecting bases 400 are installed in the female body 100, and the terminal clips 500 are inserted into the male body 200. Next, by means of the direction-indicating groove 204 to clearly show an inserting head, the male body 200 and the female body 100 are easy to be correctly assembled together, with the locking hook 206 of the restricting projection 202 of the male body 200 locked with the locking projection 106 of the female body 100. By the time, the foot 304 of each of the plugging plates 300 is inserted and fixed in the clamping mouth 502 of each of the terminal clips 500. On the contrary, in case of disassembling the male body 200 from the female body 100, a user just needs to press the restricting projection 202 to keep the locking hook 206 unrestricted from the locking projection 106 of the female body 100, and then the male body 200 and the female body 100 can be easily separated.

Figure 7:
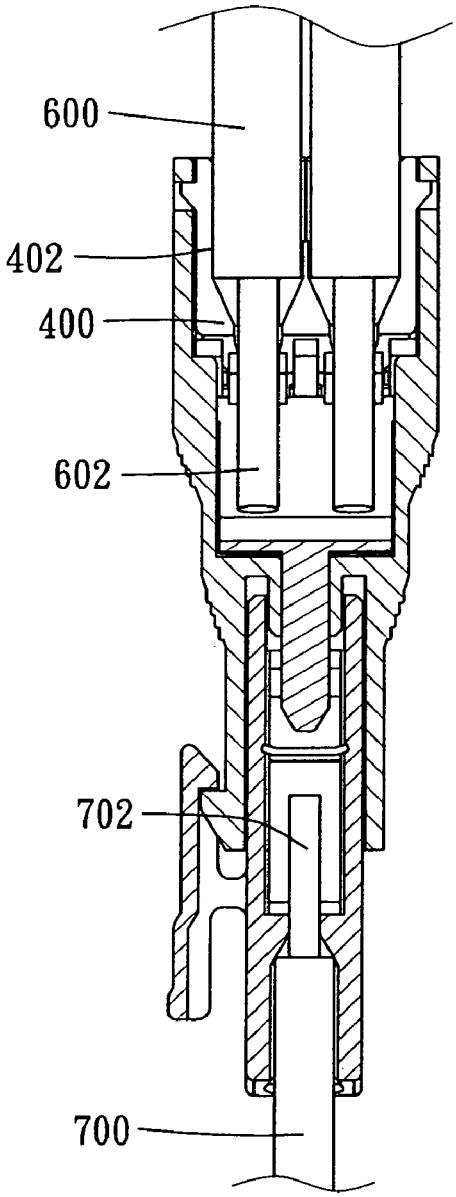
FIG. 7 is a side cross-sectional view of the preferred embodiment of a fast plugging power line connector in the present invention, showing it being plugged with power lines.
Figure 8:
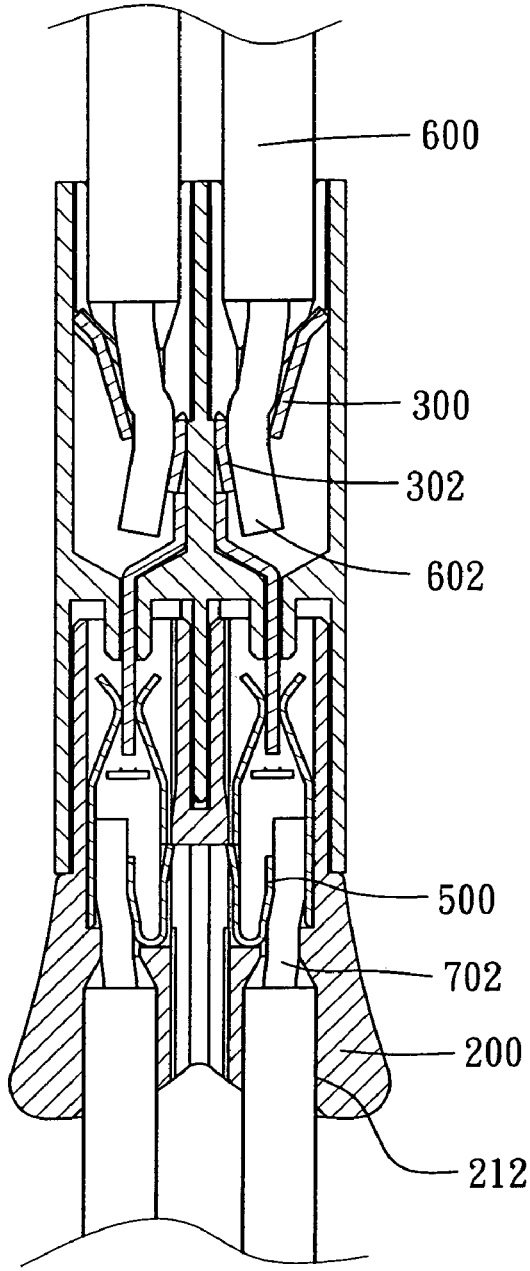
FIG. 8 is a front cross-sectional view of the preferred embodiment of a fast plugging power line connector in the present invention, showing it being plugged with power lines.

In using, as shown in FIGS. 7 and 8, a power line 600 to be connected must first has the plastics wrapped around its plugging end peeled off to get an exposed conductor 602, which is then inserted into the line connecting hole 402 of the line connecting base 400 in the female body 100, keeping it fixed in the line-clipping groove 302 of the plugging plate 300. In addition, a plugging end of another power line 700 has also to be stripped off the plastics wrapped around it to get an exposed conductor 702, which is then inserted into the plugging hole 212 of the male body 200, enabling it fixed in the terminal clip 500. Thus reliable conductance between the two power lines 600 and 700 can be thus built quickly and safely by a consumer. Especially, with provision of the top and the bottom layer of the line-clipping groove 302 of the plugging plate 300, the conductor 602 can stably be fixed therein, completely achieving an excellent performance of safety.

While the preferred embodiment of the invention has been described above, it will be recognized and understood that various modifications may be made therein and the appended claims are intended to cover all such modifications that may fall within the spirit and scope of the invention.

What is claimed is:

1. A fast plugging power line connector comprising:

a female body provided with two pairs of side holes bored in its two parallel sides, a locking projection located at a bottom of said female body, a separating wall formed inside said female body to divide said female body into two plugging grooves;

a male body provided with a separating wall to divide it into two terminal grooves, a restricting projection having a locking hook employed to mutually lock together with said locking projection of said female body;

two plugging plates to be plugged into and fixed in said plugging grooves, each of said plugging plates provided with two line-clipping grooves used to clamp a power line inserted therein, a foot extended out from one end of said plugging plate for being used as a terminal to plug in said female body;

two line connecting bases being inserted in said female body, each of said line connecting base provided with two lines connecting holes, a pair of elastic hooks located at a top portion of said line connecting base for being locked in said side holes of said female body while inserting said line connecting base in said female body;

two terminal clips to be installed in said terminal grooves of said male body; and said male body and said female body assembled by having said locking hook of said male body locked with said locking projection of said female body, said foot of said plugging plate inserted in and kept tight by said terminal clip.

2. The fast plugging power line connector as claimed in claim 1, wherein said female body is provided with an anti-slipping ladder formed of plural projecting ribs.

3. The fast plugging power line connector as claimed in claim 1, wherein said female body is provided with a projection formed at a bottom of each of said plugging grooves, a foot slot dug in each of said projections for said foot of said plugging plate to fit in.

4. The fast plugging power line connector as claimed in claim 1, wherein said terminal clip is provided with a restricting portion bent outward to lean against said separating wall of said male body.

* * * * *